United States Patent [19]

Dickey

[11] Patent Number: 5,064,488

[45] Date of Patent: Nov. 12, 1991

[54] APPARATUS AND METHOD FOR SPLICING FILM

[75] Inventor: Daniel M. Dickey, Denair, Calif.

[73] Assignee: Trine Manufacturing Company, Inc., Turlock, Calif.

[21] Appl. No.: 500,177

[22] Filed: Mar. 27, 1990

[51] Int. Cl.[5] ..... B65H 19/14; B65H 19/20; B65H 69/06

[52] U.S. Cl. ..... 156/159; 156/304.3; 156/361; 156/504; 156/505

[58] Field of Search ..... 156/504, 505, 157, 159, 156/264, 304.3, 353, 361, 502, 517

[56] References Cited

U.S. PATENT DOCUMENTS

| | | | |
|---|---|---|---|
| 3,634,170 | 1/1972 | Hottendorf | 156/504 |
| 3,637,153 | 1/1972 | King | 156/506 X |
| 3,717,057 | 2/1973 | Takimoto | 156/502 X |
| 3,769,124 | 10/1973 | Johnson | 156/159 |
| 4,081,312 | 3/1978 | Cristiani | 156/504 |
| 4,190,483 | 2/1980 | Ryan et al. | 156/504 |
| 4,390,388 | 6/1983 | Nagata et al. | 156/351 |
| 4,417,940 | 11/1983 | Koster | 156/351 |
| 4,443,291 | 4/1984 | Reed | 156/157 |
| 4,668,328 | 5/1987 | Kyytsonen | 156/502 |

*Primary Examiner*—Michael Wityshyn
*Attorney, Agent, or Firm*—Lothrop & West

[57] ABSTRACT

An apparatus and method for effecting a splice between a pair of feed rolls for successively supplying film material to a film utilization device, such as a labeling machine. Downstream from the rolls, a splicing station includes a pair of parallel, spaced film paths, carrying film from a respective roll. Movable film pads within the splicing station displace film within a selected path past a film cutter to manufacture a trailing end. Continued displacement of the trailing end brings it into adhesive engagement with the leading end of the other film, disposed within the other film path. A braking station downstream from the splicing station holds fast the film extending from the selected path during the splicing operation. Means to effect in registration splicing of film from the two rolls, while allowing continuous operation of the associated film utilization device, is also disclosed.

13 Claims, 3 Drawing Sheets

APPARATUS AND METHOD FOR SPLICING FILM

BACKGROUND OF THE INVENTION

1. Field of the Invention

The invention relates generally to splicing devices for machines which utilize film material, successively provided by a pair of feed rolls. More specifically, the invention pertains to a method and apparatus for semi-automatically splicing a full film roll to the end of a nearly depleted film roll, supplying film to a roll-fed labeling machine. The splicing operation is accomplished without stopping the labeling machine, and without losing label registration between the spliced rolls.

2. Description of the Prior Art

The prior art includes a considerable number of devices adapted for splicing rolls of tape or film so that a constant and uninterrupted supply of film material can be fed into a labeling machine, or the like. For example, U.S. Pat. No. 4,390,388 issued to Nagata et al., shows an automatic splicer which allows continuous operation of a tape feeding machine during the course of a splicing operation, while maintaining exact registration of printed patterns upon the tape through the splice. U.S. Pat. No. 4,417,940, granted to Koster, illustrates a feed roll splicer for a label machine using intermittent operation.

In Takimoto, U.S. Pat. No. 3,717,057, a pair of rotatable cutting drums and a pair of splicing drums are employed for joining an old and a new web in abutting relation. U.S. Pat. No. 4,668,328, granted to Krytsonen teaches the use of a "suction beam" during the process of taping a first web to a second web.

In Johnson, U.S. Pat. No. 3,769,124, a pair of clamping bars, a single vacuum actuated clamping bar, and a heated cutting wire adapted to pass through an arcuate path are disclosed as elements of an apparatus for splicing foam sheet material. U.S. Pat. No. 4,443,291, issued to Reed, utilizes a spring loaded swing arm to provide acceleration of the web of the new roll of material to match the speed of the expiring web.

Hottendorf, U.S. Pat. No. 3,634,170 discloses a tape splicer using a photoelectric cell to sense the tape end coming off an empty supply roll; a motor actuated by the photoelectric cell output moves a pair of clamping rolls together to splice the tapes. U.S. Pat. No. 3,637,153 issued to King shows a device for splicing and winding tape into a cassette, using an arm to take up slack and maintain tension on the tape, and a suction block and pneumatically actuated tape clamping means.

While the present invention shares the general objectives of some of the prior art discussed above, it accomplishes these objectives in a much simplified and structurally distinguishable manner from known prior art devices.

SUMMARY OF THE INVENTION

An apparatus and method for effecting a splice between a pair of rolls successively supplying film material to a film utilization device, such as a labeling machine, are disclosed. A preferred embodiment of the invention provides "in registration" splicing of film from two label rolls, while allowing uninterrupted and continuous operation of the associated labeling machine.

The splicing apparatus includes a pair of feed rolls of film material, or label stock. The film material usually contains printed material of a repetitive pattern, separated by short, transverse blank portions where film segments will subsequently be cut from the parent roll and applied to containers. During the course of the labeling operation, one of the rolls eventually becomes depleted, and the need arises to splice the leading end of the other roll to the trailing end of the depleted roll.

Downstream from the feed rolls is a splicing station, including first and second, substantially parallel, spaced film paths, each accommodating film material from a respective roll. The film from the roll in use passes first through the splicing station, then past a braking station, and finally around the idler pulley of a film tensioning arm, associated with the labeling machine.

From the film tensioning arm, the film is guided around a series of further pulleys until it reaches a film cutting mechanism, usually a rotary knife. The film is pulled by a speed controlled feed roll, such that when the leading portion of the film reaches the cutting station, the rotary knife creates individual label segments in registry with the printed material contained thereon. The labels are then immediately applied to containers, preferably by means of a vacuum drum, or the like.

Returning to the splicing station, first and second selectively translatable film pads are provided therein for effecting the actual splice. The film pads are disposed in opposing relation upon either side of the film paths, parallel and proximate to a respective path. Each pad has vacuum suction holes in its film adjacent surface, capable of securely holding film or strip material in position. Also within the splicing station is a film cutting blade, posited between the film paths and transverse thereto. The upstream ends of the first and second pads are immediately adjacent, respective cutting portions of the cutting blade.

Before making a splice, a portion of a splicing strip, having an adhesive substance on one side, is manually attached to the leading end of the film extending from the new feed roll. The splicing strip is then placed over the second film pad, remote from the film being supplied to the labeling machine.

As a further preliminary step, carried out immediately before making the splice, the film tensioning arm is slowly raised against gravity and the existing film tension into a predetermined, fixed position. The arm is maintained there by a detachable swing hook, temporarily engaged with a peg. The fixed position of the tensioning arm ensures that the exact length of film between the label machine and the cutter blade at the moment a splice is made, is repeatable for each splicing operation.

Having completed the set-up procedure, a splice can now be made. When the splicer is first actuated by an operator, nothing happens until the rotary cutter reaches a predetermined rotational position within its current cutting cycle. At that moment, a pulse encoder and a camless limit switch, operatively connected to the rotary cutter, produce a control signal directed both to the braking station and to the splicing station.

At the braking station, a movable and a stationary brake pad cooperate to grip fast the film passing to the film tensioning arm. As the labeling machine continues to run and use up film, the tensioning arm is caused to rise, automatically releasing the detachable swing hook from the peg so the tensioning arm can slowly drop and resume normal operation once the splice is made and the brake is released.

At the splicing station, a first film pad, adjacent the braked length of film, is driven by a ram or cylinder to displace the film first past the cutting blade to manufacture a trailing end of the film. Continued movement of the film pad brings the trailing end into adhesive engagement with the splicing strip supported by the second film pad, forming the splice.

The movable brake pad is immediately retracted, releasing the film and allowing the new roll to supply film to the labeling machine. The film tensioning arm gradually rotates downwardly into its normal operating position, and normal speed operation of the labeling machine is resumed.

The action of the first and second film pads is both complimentary and alternating in nature. That is to say, after the newly spliced roll becomes nearly depleted, the splicing procedure is repeated, this time with the first pad acting as a support for the splicing strip and the second pad acting as a means for displacing the film, to manufacture a trailing end and compress it against the splicing strip.

DETAILED DESCRIPTION OF THE PREFERRED EMBODIMENT

Figure 1:
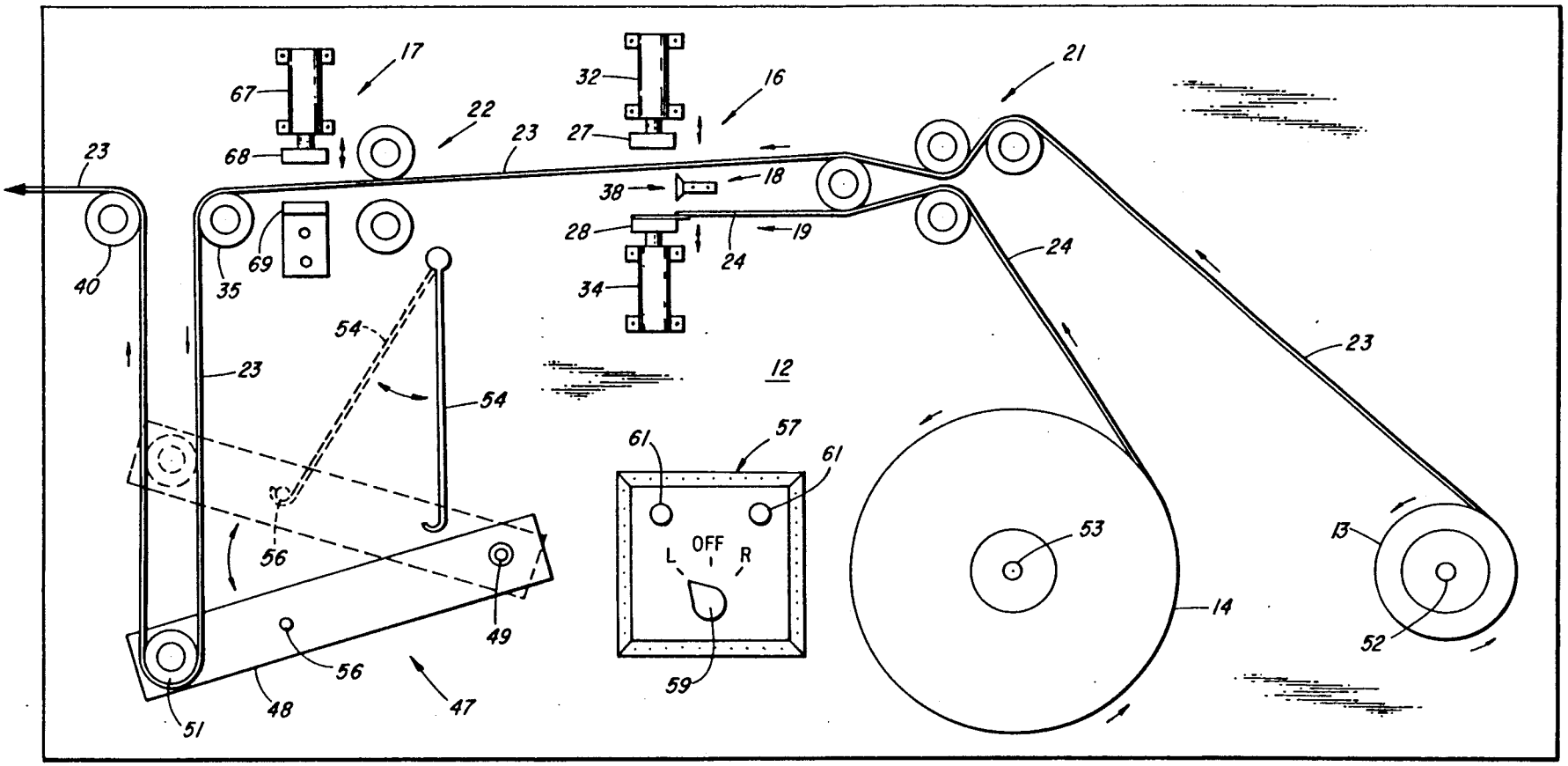
FIG. 1 is a side elevational view of the splicing apparatus, including the film tensioning arm of the labeling machine.

The splicer 11 is preferably mounted upon a frame 12, appurtenant a film or tape utilization device, such as a labeling machine or packaging apparatus, or adjacent a device for loading cassettes or containers of film or tape material. For example, the film material to be utilized or loaded may be polyester, polypropylene, polyvinylchloride, polystyrene, or paper.

More particularly, the splicer of the present invention has been used advantageously with a labeling machine such as the roll-fed device shown in my U.S. Pat. No. 4,844,760 (the '760 Patent), incorporated herein by reference. The present invention, however, contemplates that a pair of feed rolls 13 and 14, containing film material, is used to supply film or label stock to the labeling machine, rather than the single roll shown in the '760 Patent. Rolls 13 and 14 are mounted upon frame 12 in co-planar relation for rotation about respective parallel axes, facilitating downstream orientation of the film material for splicing.

By having two rolls on hand, the first roll 13 is used to feed the label machine until the roll becomes nearly depleted. Then, while maintaining continuous operation of the downstream labeling machine, the splicer 11 attaches the film extending from the second roll 14 to the film leading from the nearly depleted roll, so that a new supply of film is available.

To that end, splicer 11 further includes a splicing station 16 and a film braking station 17, preferably mounted and arranged upon frame 12, as shown in FIG. 1. Passing through splicing station 16 are a first elongated film path 18 and a second elongated film path 19. Film paths 18 and 19 are arranged and maintained in substantially parallel, spaced relation by means of rollers 21, upstream from splicing station 16, and rollers 22, upstream from braking station 17.

Figure 2:
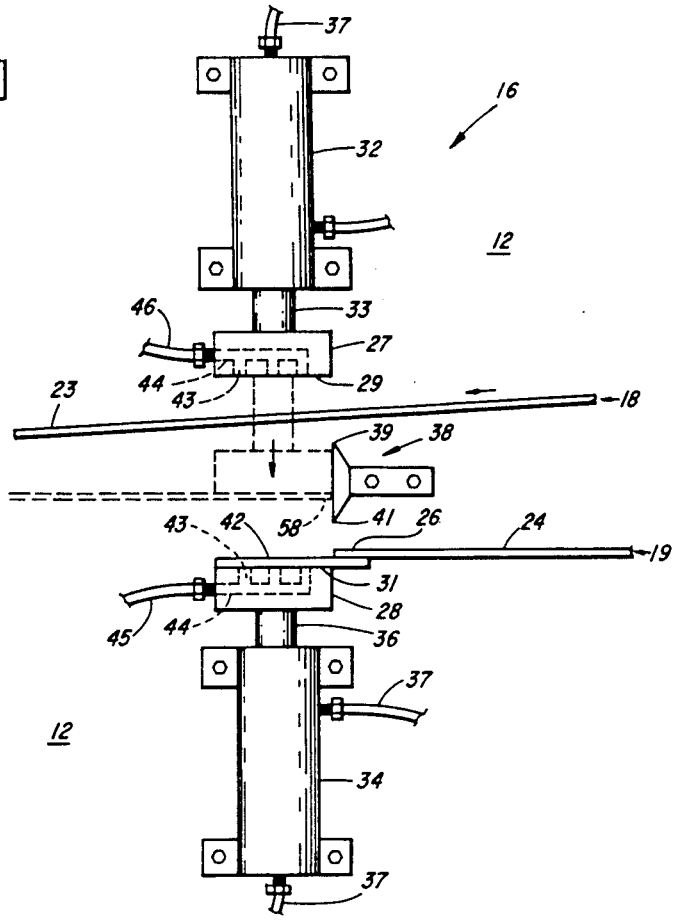
FIG. 2 is a side elevational view, taken to an enlarged scale, showing the first and second film pads and the film cutting blade in a first mode of operation.

In a first mode of operation of the splicer 11, film material 23 from first roll 13, extends through the path 18 downstream to the braking station, and thereafter leads to the associated labeling machine (not shown). Film material 24 from the second roll 14 extends through the path 19, and terminates at a leading end 26 within the splicing station 16, as shown in FIG. 2.

A first film pad 27 and an opposing second film pad 28 are also provided within the splicing station, respectively positioned on either side of the film paths 18 and 19. Pad 27 includes a film engaging surface 29 parallel to and directed toward film path 18, and pad 28 similarly has a film engaging surface 31 parallel to and directed toward film path 19.

A pneumatically actuated ram 32, or cylinder is connected to pad 27 by means of a rod 33. In like fashion, a second pneumatically actuated ram 34, or cylinder includes a rod 36 attached to pad 28. Air lines 37, interconnected to appropriate control valves and a supply of compressed air, are provided for selective actuation of splicer rams 32 and 34 to accomplish the splicing operations.

A film cutting blade 38 is provided between film paths 18 and 19, having a generally transverse orientation with respect to such paths and the film passing therethrough. Blade 38 is also positioned so that the upstream ends of pads 27 and 28 are adjacent a respective upper cutting portion 39 and a respective lower cutting portion 41 of the blade. It has been determined that cutting portions 39 and 41 are preferably serrated in nature, to manufacture clean cuts of the thin film material in a manner to be discussed more fully below. However, depending upon the film material in use, other cutting means may be more appropriate. For example, if the film material were polystyrene, or foam, a heated wire might be employed to cut the film.

As a first step in preparation for making the splice, the leading end 26 of the film material 24, must be modified or treated for adhesive attachment. This can be accomplished a variety of ways, including the use of a splicing strip 42, having an adhesive substance on one face. As shown in FIG. 2, the leading end 26 of the film 24 is adhesively attached to an upstream portion of the strip 42. With the remaining adhesively faced portion of the strip facing toward film path 18, strip 42 is placed over surface 31 of pad 28 and held there securely by suction means. For that purpose, pad 28 includes plural apertures 43 in communication with a plenum 44, and an associated vacuum line 45. Pad 27 is identically equipped but includes its own independently actuated vacuum line 46, to be described later, in the second mode of operation of the splicer 11.

Splicing strip 42 may also be coated with an adhesive substance on both sides. In that event, film 24 is placed directly over surface 31, with leading end 26 over the downstream portion of the pad 28. Then, strip 42 is laid over pad 28, having one adhesive surface engaging the film and the other adhesive surface facing the film path 18.

A last method contemplated involves the direct application of adhesive to the leading end portion of the film 24 overlying the pad 28. Adhesive may be wipe or spray applied directly to the surface of the film facing the film path 18, in preparation for splicing.

As the film material 24 typically includes printing in the form of text and designs on one outwardly facing side, it is desirable to maintain registration within such printed material in the course of making a splice. Then, when the splice reaches the labeling machine, and that spliced label is attached to a container, the labeled container will have a commercially acceptable appearance.

In addition, it is preferable that the splice occurs somewhere between the blank portions of the film, which ultimately define the leading and trailing ends of the label after it is cut from the parent roll. If the film splice were made on or about the blank portion, it is possible that the rotary cutter or the vacuum drum would malfunction in forming or handling the label. To accomplish both of the preferable aims, a special modification is made to a film tensioning arm 47, located downstream from the braking station 17.

Film tensioning arm 47, known in the industry as a "dancer arm", includes a bar 48 mounted at one end to the frame 12 for rotation about an axle 49. An idler pulley 51, about which film 23 runs, is mounted upon the other end of the bar 48. Infeed pulley 35 and outfeed pulley 40 are also provided to guide and maintain the film 23 as the film tensioning arm 47 operates. A spooling function is provided by the film tensioning arm used herein, as a certain amount of film material 23 is "stored" between pulleys 35, 51, and 40. During the splicing operation, this "stored" film allows the label machine to operate continuously, despite the fact that the upstream supply of film is temporarily halted, as will be described in more detail below.

A rotational position detector (not shown), is connected to axle 49, and produces a brake signal varying in accordance with the position of arm 47. Electric brakes, responsive to the brake signal, are connected to axles 52 and 53, respectively supporting rolls 13 and 14. Under the force of gravity, arm 47 places a suitable tension upon the film leading from the feed roll to the labeling machine. In this normal position, shown in full line in FIG. 1, the brake signal causes the electric brakes to apply a predetermined amount of torque resistance to axles 52 and 53. If the label machine speed is increased, the demand for more film material causes arm 47 to rise, and the detector sends a new brake signal to the electric brakes, correspondingly diminishing the torque resistance applied to the film roll axles. As film is supplied at a greater rate, the arm 47 gradually rotates downwardly into its normal position, and the film tension stabilizes once again.

To adapt the film tensioning arm 47 for the purposes herein, a detachable swing hook 54 is pivotally mounted to the frame 12, immediately above the arm. Also, a peg 56 is mounted upon the bar 48, for detachable engagement with the lower end extremity of the hook 54. As a further preliminary step, carried out just before a splicing operation is to begin, the operator slowly raises the bar 48 into an upper position, indicated in broken line in FIG. 1. The hook 54 is engaged with the peg 56, fully supporting the bar 48 in a fixed raised position.

A predetermined length of film material, which can be repeatedly established for each splicing operation, now exists between the mechanisms cutting and applying the labels and the film cutting blade 38.

An encoder and a programmable electronic limit switch, described in more detail in column six of my '760 patent, are included with the label machine employed herein. The limit switch, having contacts designated herein by the numeral 63, is specially programmed to produce a splicer control signal by closing those contacts, upon the rotary cutter and the mechanically linked vacuum drum mechanisms reaching predetermined rotational positions. This splicer control signal is routed through circuitry in a control box 57 to actuate appropriate components in the splicing station 16 and the braking station 17, in a manner to be described more fully below.

Through experimentation by making test splices and appropriately adjusting the programmable limit switch, a rotational position of the rotary cutter can be determined that will actuate the splicing station at the precise moment to create a splice preferably somewhere between the blank spaces on the film. It should be noted, however, that the present invention, particularly when used with other film utilization or film loading apparatus, will make satisfactory splices anywhere along the film.

By carefully examining a trailing end 58 of the film 23 manufactured during a successful test splicing run, the operator can tell exactly where the leading end 26 of the new feed roll should be cut to ensure precise label registration, when the actual splice is made. And, the location of this cut establishing the leading end 26 is the same for each splicing operation, since the length of film between the cutting blade 38 and the labeling mechanisms is the same for each such operation.

Located on the face of the control box 57, is a roll selector switch 59. In the first mode of operation, the second feed roll 14, which appears as the left roll in FIG. 1, is spliced to the film extending from the nearly depleted first feed roll 13. Accordingly, selector switch 59 is turned from the center off position, to the "L" or left position. Control box 57 also includes a pair of push buttons 61, which the operator must depress simultaneously to effect a splice. These buttons provide a safety feature as both hands must be used to depress the buttons, ensuring that the operator's hands are well removed from the splicing and braking stations.

Figure 4:
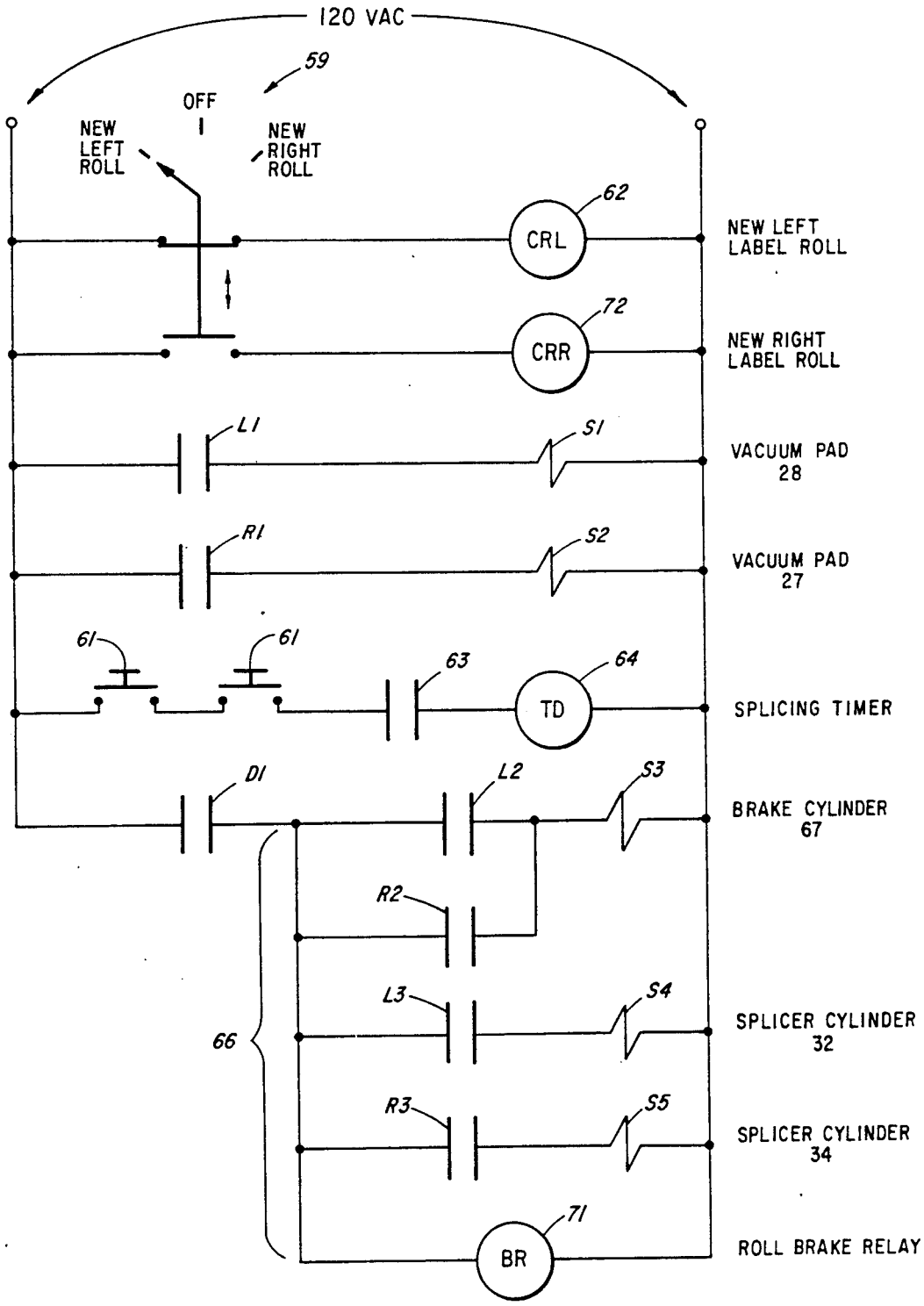
FIG. 4 is a simplified schematic representation of the combined electrical circuitry of the splicer and the electrical control elements of the label machine.

As shown in FIG. 4, the coil of control relay left 62, or CRL, is energized with selector switch 59 in the left position. Relay 62, in turn, has three sets of normally open contacts L1, L2, and L3, all of which are made or closed at this time. Power is supplied immediately to the solenoid S1, opening a valve interconnecting a vacuum pump to vacuum line 45.

As the rotary cutter mechanism reaches a predetermined position, the limit switch makes or closes contacts 63, completing the circuit through push buttons 61 to energize time delay relay 64, or TD. Normally open contacts D1 of relay 64 are thereby closed, providing power for the timed duration of the splicing operation to a brake and splicer circuit branch 66.

Since contact L2 is closed, power is applied to solenoid S3, a double acting valve routing pneumatic pressure to brake cylinder 67 at the brake station 17. A movable brake pad 68 is accordingly extended, holding film 23 fast against a stationary brake pad 69. The label machine continues labeling containers, using film material stored between pulleys 35 and 40 at a constant rate. Film tensioning arm 47 is thereby raised upwardly from its previously fixed and supported position, allowing the swing hook 54 to detach from peg 56, and return to a vertical position.

Roll brake relay 71, or BR, is also actuated, energizing the electric brakes to hold axles 52 and 53 of the feed rolls. This prevents either roll from unwinding, and eliminates film slack that might otherwise be caused by the rotational inertia of the roll in use.

Also within the brake and splicer circuit branch 66 is solenoid S4, a double acting valve providing forward and reversing pneumatic pressure to splicer cylinder 32. With contacts L3 closed, power is applied to solenoid S4, causing a forward extension of the cylinder and film pad 32 The braked length of film 23 is transversely displaced by the pad 32, passing initially by the upper cutting portion 39 of blade 38 to manufacture trailing end 58 (see FIG. 2). Continued extension of the cylinder 32 brings the newly manufactured trailing end 58 into adhesive engagement with the splicing strip 42, supported by the second film pad 28, thereby forming the splice.

Time delay relay 64 holds contacts D1 closed for the duration of the splicing operation, usually a second or so, before opening them again. With D1 open, all power to the brake and splicer circuit branch is interrupted, and solenoids S3, S4, and brake relay 71 all revert to a deactivated condition. In the case of solenoids S3 and S4, this results in the immediate retraction or withdrawal of the cylinders 32 and 67 and the associated pads 27 and 68. Brake relay 71 likewise releases the electric brakes, freeing both axles 52 and 53, and allowing the new supply roll 14 to supply film to the labeling machine. Bar 48 of the film tensioning arm 47 gradually rotates downwardly under its own weight into a normal operation position. As a final step, roll selector switch 59 is turned into the off position, deactivating control relay 62 and solenoid S1.

After the newly spliced roll 14 has been used for some time and becomes nearly depleted, the need for another splicing operation arises. A new roll is placed over axle 52, and preparatory steps are taken as before, for operating the splicer 11 in a second mode of operation.

Roll selector switch 59 is turned to the "R", or right position, actuating control relay right 72, or CRR. Relay 72 includes normally open contacts R1, R2, and R3. When closed, contacts R1 supply power to solenoid S2, thereby interconnecting vacuum line 46 with a vacuum pump. And, in a manner similar to that described above, closing contacts R2 and contacts R3, prepares brake cylinder 67 and splicer cylinder 34 for actuation, once relay contacts D1 are closed.

Figure 3:
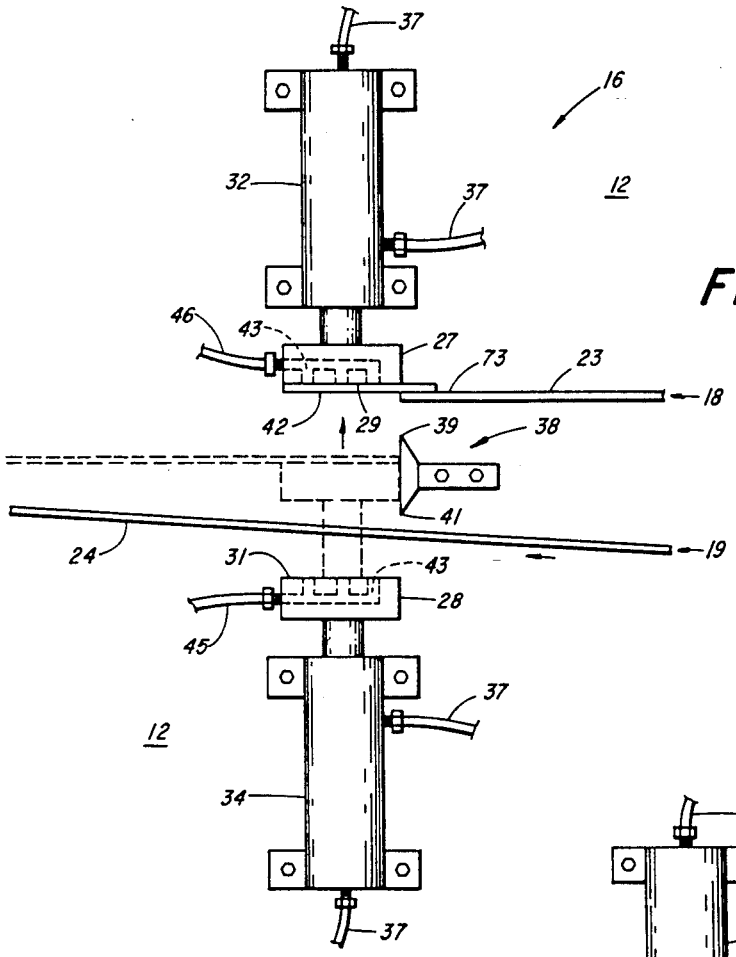
FIG. 3 is a view as in FIG. 2, but showing these elements in a second mode of operation.

A leading end 73 of film 23 (see FIG. 3) must be cut and prepared for adhesive attachment, using one of the methods described above. Leading end 73 is then placed in an appropriate position on or adjacent pad 27 depending upon the means of preparation. As before, bar 48 of film tensioning arm 47 is slowly raised into position, and engaged by swing hook 54. Push buttons 61 are simultaneously depressed, allowing time delay relay to actuate when the rotary cutter reaches a predetermined position. Brake cylinder 67, electric brake relay 71, and splicer cylinder 34 are concurrently actuated and the splice is made. Normal operation of the label machine resumes and tensioning arm 47 returns again to its standard position.

In this manner, continuous operation of the label machine is maintained, and commercially acceptable registration between spliced film material from the film supply rolls is ensured.

What is claimed is:

1. An apparatus for in registration splicing of film material having a repetitive pattern thereon, for use with a film cutter adapted to produce film segments for a film utilization device, comprising:

a. a first roll of film material, having a feed end extending to a film cutter;

b. A second roll of film material having a leading end terminating at a predetermined location therealong, said leading end having one face thereof prepared for adhesive attachment;

c. encoder means for producing a splicer control signal when the film cutter reaches a predetermined operational position;

d. a film brake station, upstream from the film cutter, and responsive to said splicer control signal, to hold fast the film material from the first roll;

e. spooling means between the film cutter and said brake station, for storing a supply of film material for the film cutter, while a splice is being formed; and f. splicing means upstream from said brake station and downstream from said rolls, and responsive to said splicer control signal, for manufacturing a trailing end in the film material form the first roll terminating at said predetermined location, and then bringing said trailing end into adhesive engagement with said leading end, forming a splice.

2. An apparatus as in claim 1, in which said predetermined location is within the repetitive pattern.

3. An apparatus as in claim 1 in which the film material has blank spaces between the repetitive pattern, and in which said predetermined location is within a blank space.

4. An apparatus as in claim 1 in which said splicing means includes:

i. first and second elongated film paths arranged in substantially parallel, spaced relation, the film material from said first roll extending through said first path downstream pst said brake station and said spooling means to the film cutter, and said leading end of said second roll extending through said second path and terminating within said splicing means;

ii. a first film pad and an opposing second film pad, respectively positioned on either side of said first and second film paths, each of said film pads having a film engaging surface parallel to and directed toward a respective said film path;

iii. means for temporarily holding said leading end upon said film engaging surface of said second pad, said prepared face being directed toward said first film path;

iv. film cutting means located between said film paths, the upstream end of said first film pad being adjacent said film cutting means;

v. means for moving said first film pad from a withdrawn position to an extending position in response to said splicer control signal, said first film pad thereby transversely displacing the film material past said film cutting means and then into adhesive engagement with said leading end.

5. An apparatus as in claim 4 in which said film cutting means includes a blade having respective cutting portions adjacent upstream ends of said first and second pads.

6. An apparatus as in claim 4 including a splicing strip having adhesive material on one side, said strip being positioned over said second film pad with the adhesive material facing toward said first film path, said leading end of the film material being adhesively attached to an upstream portion of said splicing strip, whereby in forming a splice said trailing end is brought into adhesive engagement with a downstream portion of said splicing strip.

7. An apparatus as in claim 4 including means for moving said second film pad from a withdrawn position to an extended position in response to said splicer control signal, and further including switching means for directing said control signal alternatively to said first moving means or said second moving means.

8. An apparatus as in claim 1, in which said spooling means is adjustable to provide a predetermined length of film material between said splicing means and the film cutter, whereby registration between the pattern on said trailing end of the feeding film and the pattern on said leading end of said second roll is maintained in forming the splice.

9. An apparatus as in claim 1 in which said spooling means includes a fixed infeed pulley, a fixed outfeed pulley, and an idler pulley; said infeed pulley, said idler pulley, and said outfeed pulley defining a path through which a length of stored film material passes therethrough.

10. An apparatus as in claim 9 in which said idler pulley is mounted upon an arm, said arm being pivotally mounted and resiliently biased to rotate said idler pulley away from said infeed pulley and said outfeed pulley, providing stabilized tension upon the film material.

11. An apparatus as in claim 9, including a frame and an arm mounted at one end to said frame for rotation about a horizontal axis, and in which said idler pulley is mounted on the other end of said arm for movement under gravity away from said infeed and outfeed pulleys to a normal downward position, providing stabilized tension upon the film material.

12. An apparatus as in claim 11 including a swing hook, having one end pivotally mounted to said frame and means for detachably engaging the other end of said swing hook to said arm when said arm is raised into a supported, upper position, in preparation for the formation of the splice, said upper position establishing a predetermined length of film material between the film cutter and said splicing means, whereby upon actuation of said brake station, said arm is raised upwardly by increasing film tension and said swing hook detaches from said arm, allowing said arm to rotate downwardly into said normal position.

13. A method for in registration splicing of two rolls of film material having a repetitive pattern thereon, for use with a film cutter adapted to produce film segments for a downstream film utilization device, comprising:

a. passing film material from a first roll of film material to a film cutter;

b. preparing a face of the leading end of a second roll of film material for adhesive attachment to film material;

c. holding the leading end of the second roll within a splicing station, with the prepared face parallel to and adjacent said film material from the first roll;

d. establishing a fixed predetermined length of film material between the film cutter and said splicing station;

e. producing a control signal when the film cutter reaches a predetermined operational position;

f. braking said film material from the first film roll, at a point downstream from said splicing station, in response to said control signal;

g. manufacturing a trailing end for said film material from the first film roll at said splicing station, in response to said control signal; and h. bringing said trailing end into adhesive engagement with said leading end, forming a splice between said trailing end and said leading end.

* * * * *